US006692589B2

(12) United States Patent
Warner et al.

(10) Patent No.: US 6,692,589 B2
(45) Date of Patent: Feb. 17, 2004

(54) AIRCRAFT STRUCTURE ELEMENT MADE OF AN AL-CU-MG- ALLOY

(75) Inventors: Timothy Warner, Voreppe (FR); Philippe Lassince, Issoire (FR); Philippe Lequeu, Issoire (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 10/421,774

(22) Filed: Apr. 24, 2003

(65) Prior Publication Data

US 2003/0207141 A1 Nov. 6, 2003

Related U.S. Application Data

(62) Division of application No. 09/734,661, filed on Dec. 13, 2000, now Pat. No. 6,569,542.

(30) Foreign Application Priority Data

Dec. 28, 1999 (FR) ..... 99 16610

(51) Int. Cl.[7] ..... C22F 1/04

(52) U.S. Cl. ..... 148/549; 148/550; 148/552; 148/690; 148/691; 148/694; 148/695; 148/700

(58) Field of Search ..... 148/549, 550, 148/552, 690, 691, 695, 700, 417, 439, 694

(56) References Cited

U.S. PATENT DOCUMENTS 3,874,213 A * 4/1975 Sperry et al. ..... 148/550

* cited by examiner

*Primary Examiner*—Robert R. Koehler
(74) *Attorney, Agent, or Firm*—Dennison, Schultz, Dougherty & MacDonald

(57) ABSTRACT

A process for forming a structure element, particularly an lower wing element of an aircraft, manufactured from a rolled, extruded or forged product made of an alloy of composition (% by weight) Cu=4.6–5.3, Mg=0.10–0.50, Mn=0.15–0.45, Si<0.10, Fe<0.15, Zn<0.20, Cr<0.10, other elements <0.05 each and <0.15 total, remainder Al. The product is treated by solution heat treating, quenching, controlled tension to more than 1.5% permanent deformation and aging.

9 Claims, No Drawings

AIRCRAFT STRUCTURE ELEMENT MADE OF AN AL-CU-MG- ALLOY

This application is a division of Ser. No. 09/734,661, filed Dec. 13, 2000, now U.S. Pat. No. 6,569,542 B2.

FIELD OF THE INVENTION

This invention relates to aircraft structure elements, particularly skin panels and lower wing stringers for high capacity commercial aircraft, made from rolled, extruded or forged products made of an AlCuMg alloy in the treated temper by solution heat treating, quenching and aging, and introducing a compromise between the different required usage properties that is better than is possible with products according to prior art.

The designations of the alloys and metallurgical tempers used below are according to the designations used by the Aluminum Association, and reused in European Standards EN 515 and EN 573 part 3.

STATE OF THE ART

Wings of high capacity commercial aircraft comprise an upper part consisting of a skin made of thick plates made from a 7150 alloy in T651 temper, or a 7055 alloy in T7751 temper or a 7449 alloy in T7951 temper, and stringers made from sections of the same alloy, and a lower part composed of a prefabricated skin made of thick plates of 2024 alloy in the T351 temper or 2324 alloy in the T39 temper, and stringers made from sections of the same alloy. The two parts are assembled by spars and ribs.

The 2024 alloy according to the designations of the Aluminum Association or standard EN 573-3 has the following chemical composition (% by weight):

Si<0.5, Fe<0.5, Cu=3.8–4.9, Mg=1.2–1.8, Mn=0.3–0.9, Cr<0.10, Zn<0.25, Ti<0.15.

Various alternative solutions have been proposed to improve the compromise between the various required properties, particularly mechanical strength and toughness. Boeing has developed the 2034 alloy with the following composition:

Si<0.10, Fe<0.12, Cu=4.2–4–8, Mg=1.3–1.9, Mn=0.8–1.3, Cr<0.05, Zn<0.20, Ti<0.15, Zr=0.08–0.15.

This alloy is described in patent EP 0031605 (equivalent to U.S. Pat. No. 4,336,075). Compared with the 2024 alloy in the T351 state, it has a higher specific yield strength due to the increased content of manganese and the addition of another anti-recrystallizing agent (Zr), and improved toughness and fatigue resistance.

U.S. Pat. No. 5,652,063 (Alcoa) concerns an aircraft structure element made starting from an alloy with the following composition (% by weight):

Cu=4.85–5.3, Mg=0.51–1.0, Mn=0.4–0.8, Ag=0.2–0.8, Si<0.1, Fe<0.1, Zr<0.25 and Cu/Mg is between 5 and 9.

The yield strength of the sheet metal made from this alloy in the T8 temper is >77 ksi (531 MPa) This alloy is intended particularly for supersonic aircraft.

U.S. Pat. No. 5,593,516 (Reynolds) relates to an alloy for aeronautical applications containing 2.5 to 5.5% Cu and 0.1 to 2.3% Mg, in which Cu and Mg contents are kept below their solubility limit in aluminum and are related by the following equations:

$$Cu_{max}=5.59-0.91\ Mg \text{ and } Cu_{min}=4.59-0.91\ Mg$$

The alloy may also contain Zr<0.20%, V<0.20%, Mn<0.80%, Ti<0.05%, Fe<0.15%, Si<0.10%.

U.S. Pat. Nos. 5,376,192 and 5,512,112 originating from the same initial patent application are applicable to alloys of this type containing 0.1 to 1% of silver. Note that the use of silver in this type of alloy increases the production cost and creates difficulties in recycling manufacturing scrap.

Furthermore, for many years, "AU6MGT" type alloys have been known, according to the old alloy designations in France. Patent FR 1379764 filed by Pechiney in 1963 applies to the use of an alloy of this type with composition Cu=5–7, Mg=0.10–0.50, Mn=0.05–0.50, Si<0.30, Fe<0.50, Ti=0.05–0.25 for the manufacture of compressed gas cylinders.

The Aluminum Association registered the 2001 alloy in 1976, with the following composition:

Cu=5.2–6, Mg=0.20–0.45, Mn=0.15–0.50, Si<0.20, Fe<0.20, Cr<0.10, Zn<0.10, Ni<0.05, Ti<0.20, Zr<0.05.

To the best knowledge of the inventors, there is no other industrial use of this alloy apart from compressed gas cylinders manufactured by reverse extrusion.

Problem Posed

The current trend in commercial aircraft construction is to use an increasing number of very thick products, with structure elements being machined in the body of these parts. For example, for some small aircraft, wing skins are machined from relatively thick plates to enable in-depth machining of wing stringers, although these stringers are usually made from sections or folded plates and are then mechanically fixed to the skin. Integral in-depth machining of the skin-stringer assembly can reduce manufacturing costs, since there are fewer parts and assembly is avoided. Furthermore, the use of an unassembled structure reduces the weight of the assembly.

Therefore it is desirable that, in addition to the properties normally required for aircraft structure elements, namely high mechanical strength, good tolerance to damage, good fatigue resistance and good resistance to the different forms of corrosion, plates need uniform mechanical properties throughout their thickness, in other words their properties should not vary significantly as a function of the thickness, typically between 10 and 120 mm. Furthermore, the more machining is necessary, the more desirable it becomes to maintain good stability under machining, and this is achieved by a low level of internal stresses. It is known that the mechanical properties for a thick plate are more uniform and internal stresses are lower if the plate is less sensitive to quenching.

Finally, aircraft wings, particularly for high capacity aircraft, have a curved wing profile with curvature in the longitudinal and in the transverse directions. This complex shape can be obtained in an autoclave during the aging process by forming on a mold, by applying a partial relative vacuum on the surface of the mold side of the plate, lower than the pressure on the other side. It is essential that this operation is successful to avoid expensive scrapping of parts with high added value, and particularly large parts. The key to success is in the lowest possible springback effect for a given mold shape, since springback is frequently the most difficult factor to be controlled.

The purpose of this invention is to supply aircraft structure elements with properties at least equivalent to the properties of the same elements made from a 2024 alloy in the T351 temper concerning static mechanical properties, toughness, crack propagation rate and resistance to corrosion, by using rolled, extruded or forged products with low residual stresses, low quench sensitivity and good formability during aging.

Purpose of the Invention

The purpose of the invention is a structure element, particularly a lower wing element, manufactured from a rolled, extruded or forged product made of an alloy with composition (% by weight):

Cu=4.6–5.3, Mg=0.10–0.50, Mn=0.15–0.45, Si<0.10, Fe<0.15, Zn<0.20, Cr<0.10, other elements <0.05 each and <0.15 total, the remainder being Al treated by solution heat treating, quenching, controlled tension to more than 1.5% permanent deformation and aging.

This element has at least one of the following properties:

yield strength $R_{0.2}$ (TL direction)>350 MPa, and preferably>370 MPa, toughness $K_{Ic}$ (L-T direction)>42 MPa√m resistance of P type to intercrystalline corrosion according to standard ASTM G110.

Another purpose of the invention is a manufacturing process for a structure element comprising:

a) casting a plate or a billet with the composition mentioned above, b) homogenization of this plate or billet, c) hot transformation of this plate by rolling or of this billet by extrusion or forging to obtain a product thicker than 10 mm, d) quenching of the hot transformed product, e) solution heat treating of this product, preferably at a temperature of less than 10° C. at the incipient melting temperature of the alloy, f) controlled tension of the product to obtain a permanent deformation of more than 1.5%, g) aging of the product at a temperature greater than 160° C., possibly together with forming, h) machining of the product formed until the final shape of the structure elements.

If the product is a piece of sheet metal, the entry temperature to hot rolling is preferably less than the solution heat treating temperature by at least 40° C., and even better by at least 50° C.

Description of the Invention

The invention is based on the observation that a 2001 type alloy with some changes to composition and an appropriate manufacturing procedure, can have a set of properties making it suitable for use in aircraft structures, and more particularly in the lower wing parts for high capacity commercial aircraft, also with attractive properties in terms of low quench sensitivity, low residual stresses and good forming ability during aging.

The range of the copper content is significantly lower than for the 2001 alloy, while remaining higher than 2024 and 2034 alloys for lower wing skin, to compensate for the influence of the low magnesium content on the mechanical strength. It is preferable to choose a copper content exceeding 4.8%, or even 4.9% or even 5%. The magnesium content is of the same order of magnitude as in the 2001 alloy, and is preferably between 0.20 and 0.40%. The Cu/Mg ratio is thus almost always greater than 10, unlike what is stated in U.S. Pat. No. 5652063 that recommends a Cu/Mg ratio of between 5 and 9.

The manganese content is controlled within a relatively narrow range. If it is below 0.15%, there is a risk that the grain size will be too large; if it is above 0.45%, a non-recrystallized structure is obtained which makes it more difficult to control residual stresses. The preferred range is between 0.25 and 0.40%. Note that for the same reason, the alloy does not contain any anti-recrystallizing elements such as vanadium or zirconium, unlike what is stated in U.S. Pat. No. 5,593,516.

The iron and silicon contents are kept below 0.15 and 0.10% respectively, and preferably below 0.09 and 0.08% respectively, to give good toughness. The alloy may contain up to 0.2% of zinc, this addition having a positive effect on the mechanical strength without having any negative effect on other properties such as resistance to corrosion.

The transformation procedure includes casting a plate or a billet, heating or homogenization to a temperature close to the incipient melting temperature of the alloy and hot transformation by rolling, extrusion or forging. If rolling is adopted, it may include one pass called a widening pass in the direction perpendicular to the other passes and intended to improve isotropy of the product. The hot transformation temperature is preferably slightly lower than the temperature that would normally be used by an expert in the subject with reference to the solution heat treatment temperature. Thus, for rolling, the entry temperature is preferably at least 40° C. or even 50° C. below the dissolution temperature, and the exit temperature is 20 to 30° C. below the entry temperature.

The product is then solution heat treated as completely as possible, for example at a temperature of 10° C. below the incipient melting temperature of the alloy, while avoiding burning. This temperature is between 520 and 535° C. The solution heat treatment quality may be checked by differential enthalpic analysis. The product is then quenched, for example by immersion in cold water, to achieve a cooling rate of between 10 and 50° C./s. After quenching, the product is stretched until the permanent deformation is at least 1.5% in order to reduce stresses and improve flatness. For the alloy according to the invention, this tension has the effect of improving the yield strength after aging due to a strain hardening effect, such that the temper obtained can be qualified as a T851 temper, as if it were a specific strain hardening pass after quenching. As mentioned above, aging itself can take place at the same time as the curved shape of the lower wing panel is formed. This aging is preferably done at a temperature exceeding 160° C. (and even better >170° C.) and sufficiently long to reach the peak yield strength, as for a T6 temper. Typically, aging for a time equivalent to aging for 12 to 24 h at a temperature of 173° C. is achieved; any time—temperature combination capable of reaching the alloy aging peak can be used.

The resulting metallurgical structure is strongly recrystallized, unlike the structure obtained with 2024 and 2034 alloys, with a recrystallization rate always exceeding 70%, and usually exceeding 90%, over the entire thickness.

Structure elements according to the invention have compromise properties (static mechanical characteristics, toughness, crack propagation rate, corrosion resistance) that make them suitable for use in aeronautical construction, and particularly for making lower wing skin panels. Furthermore, these elements may easily be made by machining and formed during aging. Finally, the alloy used is easily weldable using standard techniques, so that the number of riveted assemblies can be reduced.

In addition, lower wing elements may be produced according to the invention by machining, in which the skin and stringers are obtained by machining the same initial product.

EXAMPLES

Example 1

Six alloys were prepared with the composition shown in Table 1. Alloy A is a 2024-T3 alloy with a typical composition for the lower wing skin application. Alloy B is an alloy used in the composition range described in U.S. Pat. No. 5,652,063, but without the addition of silver. Alloy C is conform with the invention. Alloys D and E are the same as alloy C except that the silicon content is higher for D, the manganese and copper contents are higher for E and F, and zirconium has been added for F.

TABLE 1

| Alloy | Si | Fe | Cu | Mn | Mg | Ti | Zr |
|---|---|---|---|---|---|---|---|
| A | 0.07 | 0.07 | 4.11 | 0.53 | 1.28 | 0.008 | |
| B | 0.06 | 0.08 | 4.73 | 0.30 | 0.67 | 0.065 | |
| C | 0.05 | 0.08 | 5.26 | 0.30 | 0.28 | 0.062 | |
| D | 0.15 | 0.08 | 5.28 | 0.30 | 0.31 | 0.065 | |
| E | 0.07 | 0.10 | 5.64 | 0.99 | 0.29 | 0.012 | |
| F | 0.06 | 0.08 | 5.47 | 0.67 | 0.29 | 0.014 | 0.11 |

380×120 mm cast plates were homogenized, hot rolled to a thickness of 22 mm, solution heat treated, quenched in cold water, stretched to a 2.3% permanent deformation and aged. Table 2 contains parameters for homogenization, hot rolling (entry temperatures), solution heat treating and aging.

TABLE 2

| Alloy | Homogenization | Hot rolling (entry) | Solution heat treating | Aging |
|---|---|---|---|---|
| A | 4 h at 490° C. | 467° C. | 3 h at 497° C. | — |
| B | 4 h at 490° C. | 467° C. | 3 h at 518° C. | 16 h at 173° C. |
| C | 4 h at 490° C. | 467° C. | 6 h at 527° C. | 16 h at 173° C. |
| D | 4 h at 490° C. | 472° C. | 6 h at 527° C. | 16 h at 173° C. |
| E | 1 h at 520° C. | 479° C. | 6 h at 527° C. | 16 h at 173° C. |
| F | 1 h at 520° C. | 474° C. | 6 h at 527° C. | 16 h at 173° C. |

The mechanical properties on the heat treated plates including the ultimate tensile strength $R_m$ (in MPa), the conventional yield strength at 0.2% $R_{0.2}$ (in MPa) and elongation at failure A (in %), were measured on specimens with a circular cross-section according to standard ASTM B 557, taken from the mid-thickness in the L and TL directions (3 test pieces per case).

The toughness was also measured by a critical stress intensity factor $K_{Ic}$ (in MPA √m) measured according to standard ASTM E 399, on CT20 test pieces taken at a quarter thickness in the L-T and T-L directions (2 samples per case).

All results are shown in table 3.

TABLE 3

| Alloy | $R_m$ (L) | $R_{0.2}$ (L) | A (L) | $R_m$ (TL) | $R_{0.2}$ (TL) | A (TL) | $K_{Ic}$ (L-T) | $K_{Ic}$ (T-L) |
|---|---|---|---|---|---|---|---|---|
| A | 472 | 362 | 21.3 | 467 | 321 | 21.4 | 41.8 | 40.5 |
| B | 476 | 439 | 12.5 | 475 | 427 | 11.2 | 41.3 | 34.6 |
| C | 458 | 396 | 13.9 | 463 | 384 | 12.6 | 45.4 | 42.9 |
| D | 460 | 397 | 13.6 | 465 | 387 | 12.2 | 40.5 | 36.4 |
| E | 488 | 423 | 10.5 | 480 | 403 | 9.4 | 36.8 | 29.3 |
| F | 480 | 418 | 11.6 | 481 | 402 | 10.1 | 40.2 | 33.6 |

It can be seen that alloy C according to the invention gives a significantly higher yield strength than the 2024 alloy, and slightly lower than alloys B, E and F. The elongation is lower than for the 2024, but is better than for alloys B, D, E and F. The toughness is the best out of all the tested alloys. Therefore, a good compromise is obtained between these various properties. In particular, the results show the unfavorable effect of increasing the silicon and manganese content and adding zirconium on the toughness and elongation.

Accelerated intercrystalline corrosion tests were also carried out on samples of the six alloys in the T351 temper for alloy 2024 (A) and the T851 temper for other alloys, on the surface and in depth, according to standard ASTM G110. The corrosion type observed was marked by entering P for pitting, I for intercrystalline corrosion and P+I for both. The maximum depth (P max in μm), the intercrystalline corrosion depth (P CI in μm) and the percentage of intercrystalline corrosion on the sample, were measured. The results are shown in table 4:

TABLE 4

| Alloy | Surf. Type | Surf. P max | Surf. P CI | Surf. % CI | In-depth Type | In-depth P max | In-depth P CI | In-depth % CI |
|---|---|---|---|---|---|---|---|---|
| A | I + P | 160 | 70 | 10 | I + P | 260 | 260 | 60 |
| B | P + I | 130 | 30 | 10 | P + I | 160 | 50 | 10 |
| C | P | 150 | — | — | P | 120 | — | — |
| D | P | 150 | — | — | P | 120 | — | — |
| E | P | 200 | — | — | P | 140 | — | — |
| F | P | 220 | — | — | P | 170 | — | — |

It is found that the alloy according to the invention has the second best resistance to intercrystalline corrosion on the surface, and the best in-depth resistance. The difference between the in-depth and surface results is small, which is a desirable property when the structure element is made by machining.

Finally, the fatigue crack propagation rates da/dn in the T-L direction were compared for the A and C alloys, in mm/cycle, for values of ΔK between 15 and 30 MPa√m according to standard ASTM E647. The results (two tests per alloy) are given in table 5.

TABLE 5

| Alloy | 10 MPa ✓m | 15 MPa✓m | 20 MPa✓m | 25 MPa✓m | 30 MPa✓m |
|---|---|---|---|---|---|
| A | $6.2\ 10^{-5}$ | $3.8\ 10^{-4}$ | $8.3\ 10^{-4}$ | $1.8\ 10^{-3}$ | $3.8\ 10^{-3}$ |
| A | $6.3\ 10^{-5}$ | $3.8\ 10^{-4}$ | $8.7\ 10^{-4}$ | $1.9\ 10^{-3}$ | $3.6\ 10^{-3}$ |
| C | $1.2\ 10^{-4}$ | $4.0\ 10^{-4}$ | $8.6\ 10^{-4}$ | $1.5\ 10^{-3}$ | $2.6\ 10^{-3}$ |
| C | $1.2\ 10^{-4}$ | $4.2\ 10^{-4}$ | $9.5\ 10^{-4}$ | $1.8\ 10^{-3}$ | $3.1\ 10^{-3}$ |

It can be seen that the results are fairly similar for both alloys.

Example 2

Residual stresses were measured on 40 mm thick plates made of alloys 2024, 2034 and the alloy according to the invention, all three being treated in the same T351 temper. The compositions (% by weight) are given in table 6:

TABLE 6

| Alloy | Si | Fe | Cu | Mn | Mg | Ti | Zr |
|---|---|---|---|---|---|---|---|
| 2024 | 0.12 | 0.20 | 4.06 | 0.54 | 1.36 | 0.02 | |
| 2034 | 0.05 | 0.07 | 4.30 | 0.98 | 1.34 | 0.02 | 0.10 |
| Invent. | 0.05 | 0.07 | 5.12 | 0.35 | 0.29 | 0.02 | |

The bar method described in patent EP 0731185 issued to the applicant is used for measuring residual stresses. The deflections $f_L$ and $f_{TL}$ in the L and TL directions were measured (in microns) and in both cases the quotient $fe/l^2$, the thickness e and the length 1 of the bar were calculated and expressed in mm. The results are given in table 7:

TABLE 7

| Alloy | e (mm) | I (mm) | $f_L$ (μm) | $f_L e/1^2$ | $f_{TL}$ (μm) | $f_{TL} e/1^2$ |
|---|---|---|---|---|---|---|
| 2024 | 40 | 180 | 210 | 0.26 | 120 | 015 |
| 2034 | 40 | 180 | 147 | 0.18 | 129 | 0.16 |
| Invent. | 40 | 180 | 46 | 0.06 | 4 | 0.005 |
| Invent. | 80 | 385 | 84 | 0.05 | 136 | 0.07 |

It is found that unlike the test pieces made from the 2024 or 2034 alloys, the deflection of the test samples according to the invention is such that the product fe is less than 0.10 $l^2$, which indicates low internal stresses as described in patent EP 0731185 mentioned above.

In the above measurements, f is expressed in microns, e is the thickness of the element and L is the length of a bar-shaped test sample in millimeters.

Image analysis on micrographs of the four previous samples was used to measure the recrystallization rate (in %) on the surface, at a quarter thickness and in-depth. Table 8 contains the results:

TABLE 8

| Alloy | e (mm) | Surface | Recrystallization rate (quarter thickness) | Recrystallization rate (in-depth) |
|---|---|---|---|---|
| 2024 | 40 | 80 | 60 | 30 |
| 2034 | 40 | 12 | 0 | 0 |
| Inv. | 40 | 100 | 100 | 100 |
| Inv. | 80 | 100 | 100 | 100 |

It can be seen that the alloy according to the invention has a completely recrystallized structure throughout the entire product thickness.

Example 3

Static mechanical characteristics (yield strength $R_{0.2}$ and ultimate tensile strength $R_m$ in MPa and elongation A in %) were measured at quarter thickness and at mid-thickness, in the L and TL directions on samples according to the invention with thicknesses equal to 15, 40 and 80 mm treated in T851 temper, a hot rolling entry temperature equal to 475° C., solution heat treating for 2 h at 528° C., and aging for 24 h at 173° C. All results are shown in table 9. They show the small change to the properties as a function of the thickness, due to low quench sensitivity.

TABLE 9

| e (mm) | Sampling | $R_{0.2(L)}$ | $R_{m(L)}$ | $A_{(L)}$ | $R_{0.2(TL)}$ | $R_{m(TL)}$ | $A_{(TL)}$ |
|---|---|---|---|---|---|---|---|
| 15 | 1/2 thick | 400 | 451 | 13.6 | 392 | 458 | 12.1 |
| 40 | 1/2 thick | 387 | 439 | 13.7 | 376 | 448 | 11.2 |

TABLE 9-continued

| e (mm) | Sampling | $R_{0.2(L)}$ | $R_{m(L)}$ | $A_{(L)}$ | $R_{0.2(TL)}$ | $R_{m(TL)}$ | $A_{(TL)}$ |
|---|---|---|---|---|---|---|---|
| 80 | 1/2 thick | 388 | 436 | 11.4 | 376 | 443 | 9.8 |
| 80 | 1/4 thick | 410 | 466 | 11.9 | 467 | 400 | 9.7 |

These plates are particularly suitable for the manufacture of aircraft lower wing elements using a manufacturing procedure including machining and one or several shaping operations.

What is claimed is:

1. Manufacturing process for a structure element comprising:

a) casting a plate or a billet with a composition consisting essentially of, in wt. %, Cu=4.6–5.3, Mg=0.10–0.50, Mn=0.15–0.45, Si<0.10, Fe<0.15, Zn<0.20, Cr<0.10, other elements <0.05 each and <0.15 total, remainder aluminum, b) homogenization of the plate or billet, c) hot transformation of the plate by rolling or of the billet by extrusion or forging to obtain a product thicker than 10 mm, d) quenching of the hot transformed product, e) solution heat treating of quenched product, f) controlled tension of the solution heat treated product to obtain a permanent deformation of more than 1.5%, g) aging of the product subsequent to controlled tension at a temperature greater than 160° C., optionally together with forming, and h) machining of the aged product formed to obtain a final shape of the structure elements.

2. Process according to claim 1, wherein the cast plate or billet has a Cu content >4.8%.

3. Process according to claim 1, wherein the cast plate or billet has an Mg content between 0.20 and 0.40%.

4. Process according to claim 1, where the cast plate or billet has an Mn content between 0.25 and 0.40%.

5. Process according to claim 1, wherein the aging temperature is >170° C.

6. Process according to claim 1, wherein the product is a plate obtained by hot rolling with an entry temperature at least 40° C. below the solution heat treatment temperature.

7. Process according to claim 1, wherein the product is a plate obtained by hot rolling with an entry temperature at least 50° C. below the solution heat treatment temperature.

8. Process according to claim 1, wherein solution heat treating of the quenched product takes place at a temperature of less than 10° C. at the incipient melting temperature of the alloy.

9. Process according to claim 2, wherein the cast plate or billet has a Cu content>4.9%.

* * * * *